US007451744B2

(12) United States Patent
Imamura

(10) Patent No.: US 7,451,744 B2
(45) **Date of Patent: *Nov. 18, 2008**

(54) FORWARD MOUNTING ARRANGEMENT OF A FUEL INJECTOR IN A VEHICLE

(75) Inventor: Takaaki Imamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 244 days.

This patent is subject to a terminal disclaimer.

(21) Appl. No.: 11/204,784

(22) Filed: Aug. 16, 2005

(65) Prior Publication Data

US 2006/0037584 A1 Feb. 23, 2006

(30) Foreign Application Priority Data

Aug. 23, 2004 (JP) ..... 2004-241762

(51) Int. Cl.
*F02M 61/14* (2006.01)
*F02M 35/10* (2006.01)

(52) U.S. Cl. ..... 123/470; 123/184.21

(58) Field of Classification Search ..... 123/184.21, 123/184.38, 468–469, 509, 505, 470–472, 123/445, 229; 180/229
See application file for complete search history.

(56) References Cited

U.S. PATENT DOCUMENTS 5,269,243 A * 12/1993 Mochizuki ..... 123/41.55
6,192,865 B1 * 2/2001 Hori et al. ..... 123/470
6,202,626 B1 * 3/2001 Ito et al. ..... 123/336
6,357,424 B1 * 3/2002 Sonoda et al. ..... 123/509
6,422,332 B1 * 7/2002 Takata et al. ..... 180/68.3
6,626,155 B1 * 9/2003 Ueda et al. ..... 123/509
7,237,534 B2 * 7/2007 Imamura ..... 123/470
2005/0028790 A1 * 2/2005 Ikeda et al. ..... 123/470

FOREIGN PATENT DOCUMENTS

EP 1 296 035 A2 * 3/2003
JP 2000-249028 9/2000
JP 2002-037165 2/2002

* cited by examiner

*Primary Examiner*—Stephen K Cronin
*Assistant Examiner*—Ka Chun Leung
(74) *Attorney, Agent, or Firm*—Keating & Bennett, LLP

(57) ABSTRACT

A vehicle is capable of preventing the temperature of the fuel injector from becoming high due to engine heat and also facilitating installation and maintenance of the fuel injector. The vehicle includes a head pipe, a body frame coupled with the head pipe and extending downward to the rear, an engine arranged below the body frame, a cylinder axis of the engine being oriented substantially horizontal, an intake passage for supplying air to the engine, and a fuel injector mounted on a midsection of the intake passage for supplying fuel to the engine. At least a portion of the fuel injector is arranged forward relative to a centerline of the intake passage when viewed from the side of the vehicle body.

13 Claims, 12 Drawing Sheets

FORWARD MOUNTING ARRANGEMENT OF A FUEL INJECTOR IN A VEHICLE

BACKGROUND OF THE INVENTION

1. Field of the Invention

The present invention relates to a vehicle, and more particularly to a vehicle provided with a fuel injector for supplying fuel to an engine.

2. Description of the Related Art

As a conventional type of such vehicle, a motorcycle provided with a fuel injector for supplying fuel to the engine is well known. See JP-A-2002-37165 and JP-A-2000-249028, for example. These patents disclose a motorcycle having a fuel injection valve (fuel injector) for supplying fuel to the engine located on the rear side of an intake pipe.

A structure of these motorcycles has the fuel injection valve located on the rear side of the intake pipe because of the fact that the use of a head wind to cool the fuel injection valve is not taken into consideration. This structure prevents the fuel injection valve from being exposed to the head wind. Possible high temperature of the fuel injection valve, which could result from engine heat, prevents the fuel injection valve from being effectively cooled using a head wind. This has an undesirable tendency for fuel in the fuel injection valve to be vaporized. If the fuel supplied from the fuel injection valve to the engine is vaporized, measuring an accurate quantity of such fuel becomes difficult. This causes a problem for the fuel injection valve (fuel injector) in supplying an accurate quantity of fuel to the engine. In addition, the fuel injection valve disclosed in the above-described patents is located on the rear side of the intake pipe, and therefore installation and maintenance of the fuel injection valve needs to be done from the back of the vehicle body (rearward of the intake pipe). Such installation and maintenance of the fuel injection valve from the back of the intake pipe requires removal of the body cover and engine. This makes installation and maintenance of the fuel injection valve (fuel injector) much more complicated, which is also a problem.

SUMMARY OF THE INVENTION

In order to overcome the problems described above, preferred embodiments of the present invention provide a vehicle that is capable of preventing the temperature of the fuel injector from becoming high due to engine heat, and facilitating installation and maintenance of the fuel injector.

A vehicle according to a preferred embodiment of the present invention includes a head pipe, a body frame coupled with the head pipe and extending downward to the rear, an engine arranged below the body frame, a cylinder axis of the engine being oriented substantially horizontal, an intake passage for supplying air to the engine, and a fuel injector mounted on a midsection of the intake passage for supplying fuel to the engine. At least a portion of the fuel injector is arranged forward relative to a centerline of the intake passage when viewed from the side of the vehicle body.

The vehicle according to the present preferred embodiment is preferably an underbone type vehicle provided with a body frame extending downward from the rear of the head pipe, in which at least a portion of the fuel injector is arranged forward relative to the centerline of the intake passage when viewed from the side of the vehicle body. This allows at least a portion of the fuel injector to be located forward of the intake passage, which helps the head wind directly hit the fuel injector. Thus, a sufficient amount of head wind can be ensured to cool the fuel injector which prevents the temperature of the fuel injector from becoming high. At least a portion of the fuel injector is arranged forward relative to the centerline of the intake passage when viewed from the side of the vehicle body. This allows installation and maintenance of the fuel injector to be done from the front of the vehicle body. Unlike the installation and maintenance of the fuel injector from the back of the intake passage, the body cover and the engine need not be removed. This can facilitate installation and maintenance of the fuel injector.

Other features, elements, characteristics, and advantages of the present invention will be apparent from the following detailed description of preferred embodiments with reference to the attached drawings.

DETAILED DESCRIPTION OF PREFERRED EMBODIMENTS

Figure 1:
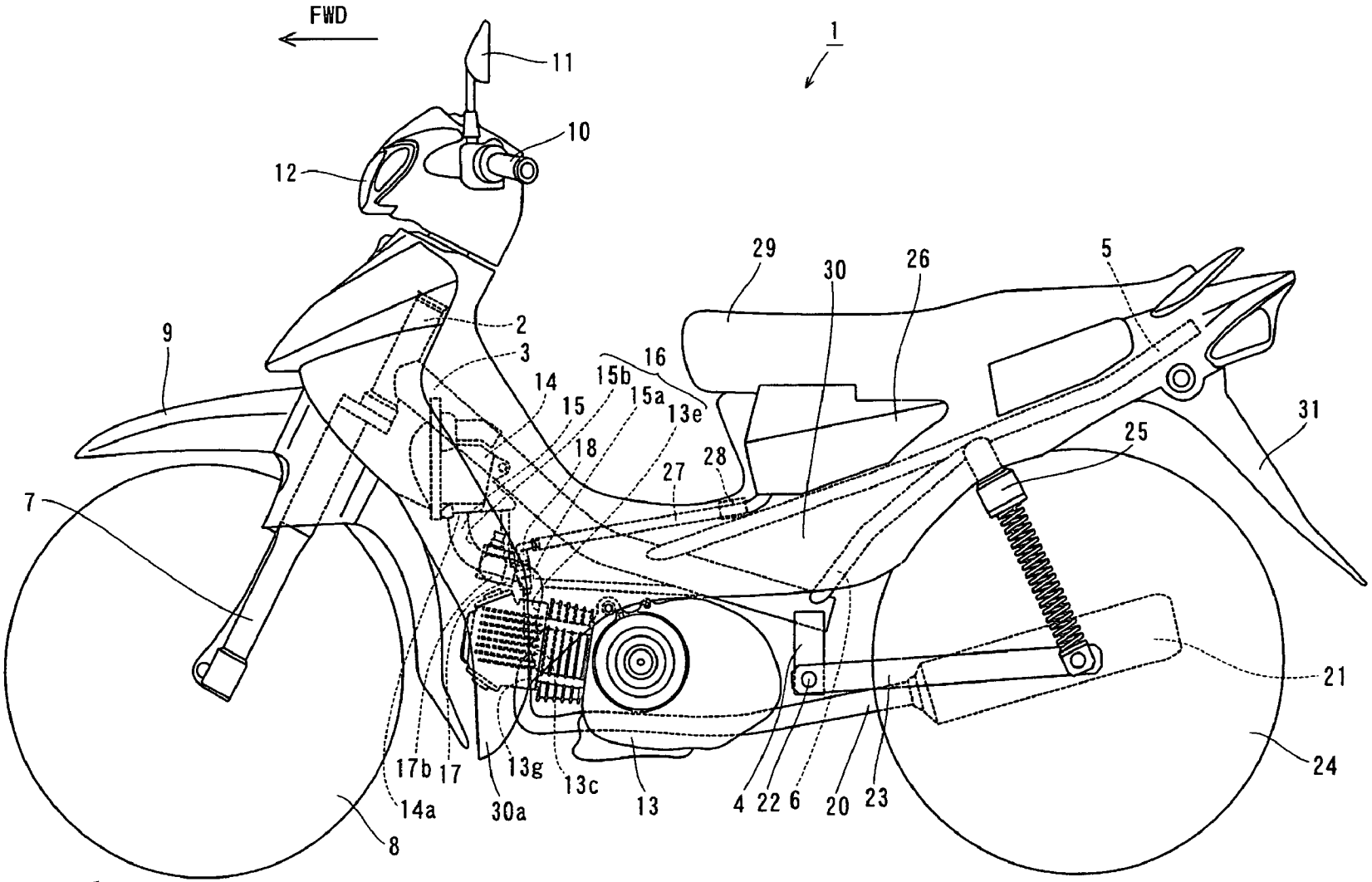
FIG. 1 is a side view of a motorcycle according to a preferred embodiment of the present invention.
Figure 2:
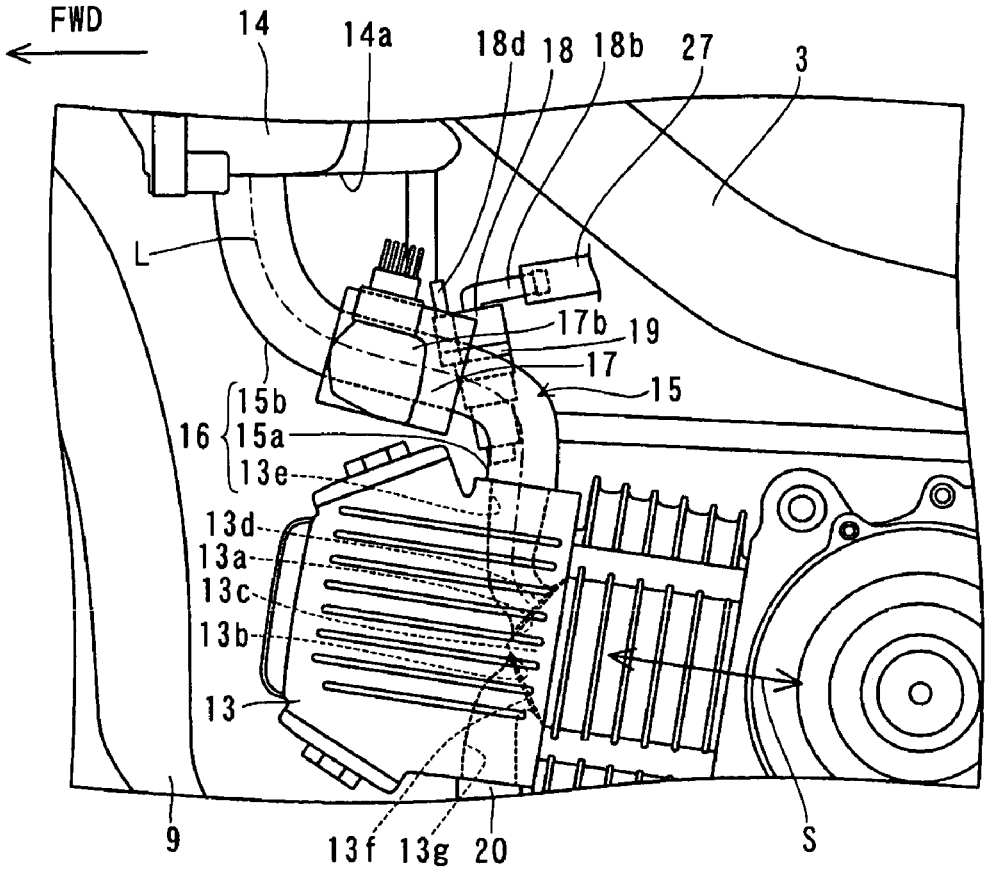
FIG. 2 is a side view of an engine and its surroundings of the motorcycle according to the preferred embodiment shown in FIG. 1.

FIG. 1 is a side view of a motorcycle according to a preferred embodiment of the present invention, showing the entire structure. FIG. 2 is a side view of an engine and its surroundings of the motorcycle according to the preferred embodiment shown in FIG. 1. FIGS. 3 through 10 are illustrations of the detailed structure of the motorcycle according to the preferred embodiment shown in FIG. 1. The arrow FWD in the drawings indicates the forward direction in which the motorcycle 1 moves. In the present preferred embodiment of the present invention, an underbone type motorcycle is described as an example of the vehicle of the present invention. A main frame of this underbone type motorcycle, which is interposed between a seat and handlebars, is positioned lower to help a rider more easily straddle the vehicle. With reference to FIGS. 1 through 10, the detailed structure of the motorcycle according to a preferred embodiment of the present invention is described as follows.

An underbone type motorcycle 1 according to a preferred embodiment of the invention preferably includes a head pipe 2 connected to a front end of a main frame 3, as shown in FIG.1. The main frame 3 is arranged to extend downward to the rear. A rear arm bracket 4 is connected to the rear end of the main frame 3. A seat rail 5 is connected to the main frame 3. A backstay 6 is connected between the rear end of the main frame 3 and a central portion of the seat rail 5. The head pipe 2, main frame 3, rear arm bracket 4, seat rail 5 and backstay 6 define a body frame.

A pair of front forks 7 is mounted at the bottom of the head pipe 2. A front wheel 8 is rotatably mounted to the bottom ends of the front forks 7. Above the front wheel 8, a front fender 9 is disposed to cover the front wheel 8 from above. Handlebars 10 are fixed to a top end of the head pipe 2. A rear view mirror 11 is fixed on the inner side of the handlebars 10. A headlight 12 is disposed forward on the inner side of the handlebars 10.

Figure 3:
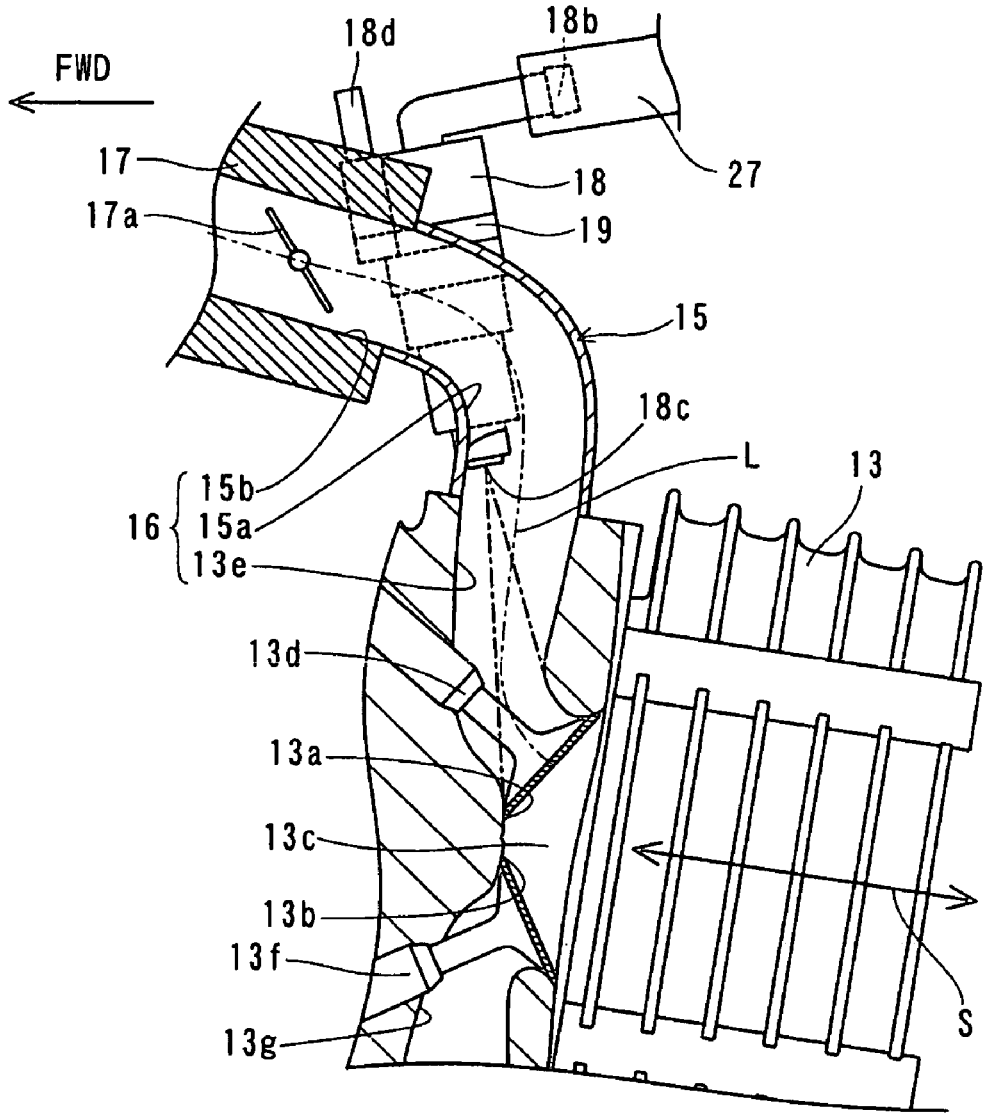
FIG. 3 is a side view of the engine and its surroundings of the motorcycle according to the preferred embodiment shown in FIG. 1.

An engine 13 is located below the main frame 3. As shown in FIGS. 2 and 3, the engine 13 is arranged such that the axial direction of a cylinder (not shown) or "S" direction is substantially horizontal. The engine 13 includes a combustion chamber 13*c* having an inlet port 13*a* and an exhaust port 13*b*, an intake valve 13*d* for opening/closing the inlet port 13*a* of the combustion chamber 13*c*, an intake passage portion 13*e* for supplying gasoline and air to the combustion chamber 13*c*, an exhaust valve 13*f* for opening/closing the exhaust port 13*b* of the combustion chamber 13*c*, and an exhaust passage portion 13*g* for emitting exhaust gas from the combustion chamber 13*c*. The intake passage portion 13*e* is an example as the "first intake passage portion" of the present invention. The intake passage portion 13*e* is arranged to continue from the inlet opening 13*a*. A portion of the intake passage portion 13*e* is arranged to extend upward substantially in the vertical direction. The exhaust passage portion 13*g* is arranged to extend downward.

Figure 4:
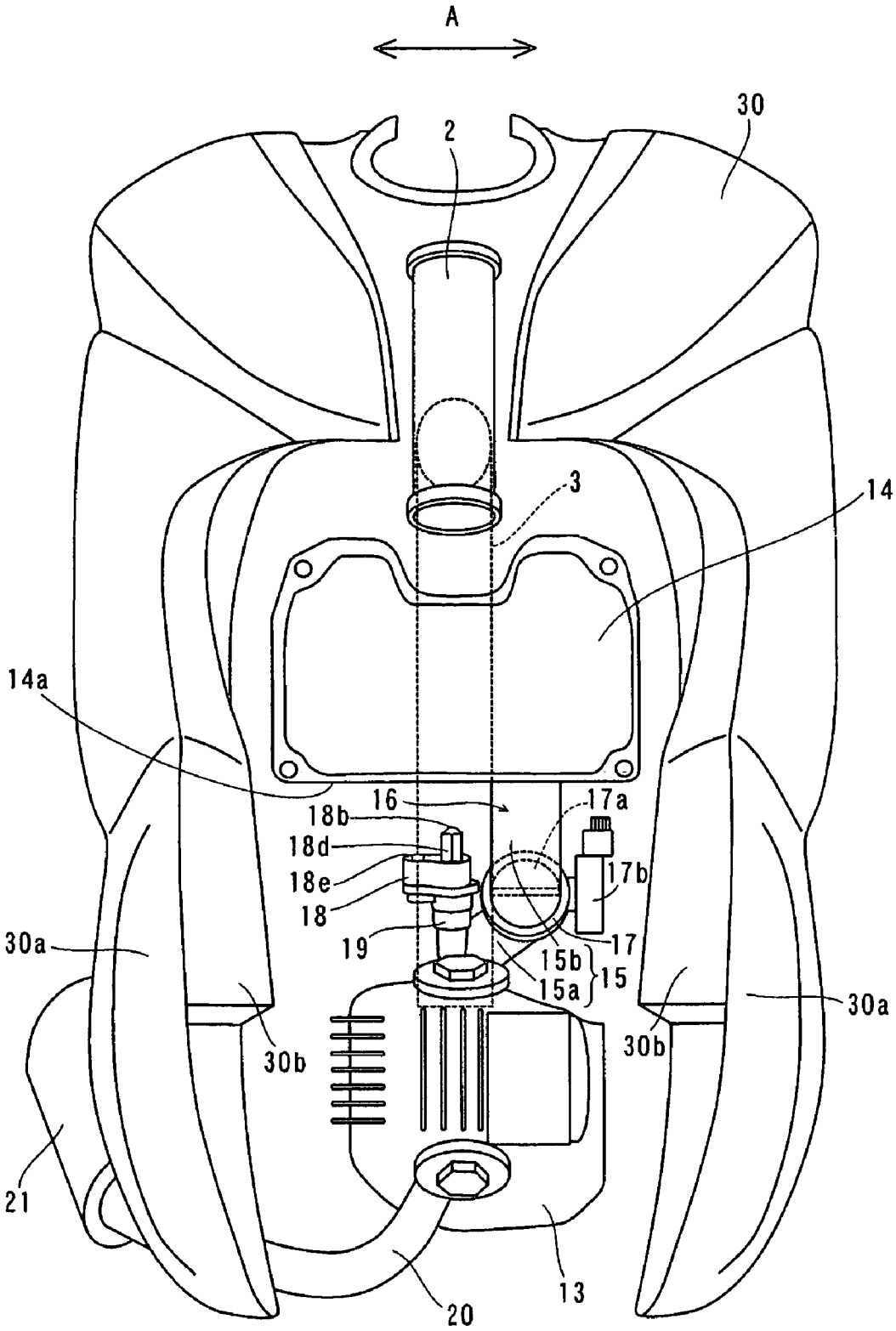
FIG. 4 is a front view of the engine and its surroundings as well as a body cover of the motorcycle according to the preferred embodiment shown in FIG. 1.

As shown in FIG. 1, an air cleaner 14 is provided forward and upward of the engine 13 to purify air to be supplied to the engine 13. The air cleaner 14 is disposed forward and upward of the fuel injector 18, as shown in FIGS. 2 and 4. The air cleaner 14 has a bottom surface 14*a* extending in the lateral ("A" direction in FIG. 4) and longitudinal direction of the vehicle body. Also, the air cleaner 14 is connected to the intake passage portion 13*e* (see FIG. 2) of the engine 13 via an intake pipe 15.

In the present preferred embodiment, as shown in FIGS. 2, 4, 7 and 8, the intake pipe 15 preferably includes an intake passage portion 15*a* having a section that is bent in the lateral direction of the vehicle body ("A" direction in FIGS. 4, 7 and 8) and a section extending obliquely upward to the front (FWD direction in FIGS. 2 and 8) and an intake passage portion 15*b* arranged to continue from the end of the portion of the intake passage portion 15*a*, which extends obliquely upward to the front, and to extend forward and upward. The intake passage portion 15*a* is an example of the "intake passage portion" and "second intake passage portion" of the present preferred embodiment of the present invention. The intake passage portion 15*b* is an example of the "third intake passage portion" of the present invention. The end of the portion of the intake passage portion 15*a*, which curves in the lateral direction of the vehicle body, is arranged to continue from the intake passage portion 13*e* (see FIGS. 2 and 7) of the engine 13. The intake passage portion 15*b* is connected to the air cleaner 14 as shown in FIG. 1. More specifically, the intake passage portion 13*e* of the engine 13 and the intake passage portions 15*a* and 15*b* of the intake pipe 15 define an intake passage 16 for supplying air from the air cleaner 14 to the engine 13. As shown in FIG. 4, a throttle body 17 is attached to the intake passage portion 15*b* of the intake pipe 15. The throttle body has a throttle valve 17*a* (see FIG. 3) and a throttle opening sensor 17*b* both designed to control the quantity of air to be supplied to the engine 13.

Figure 5:
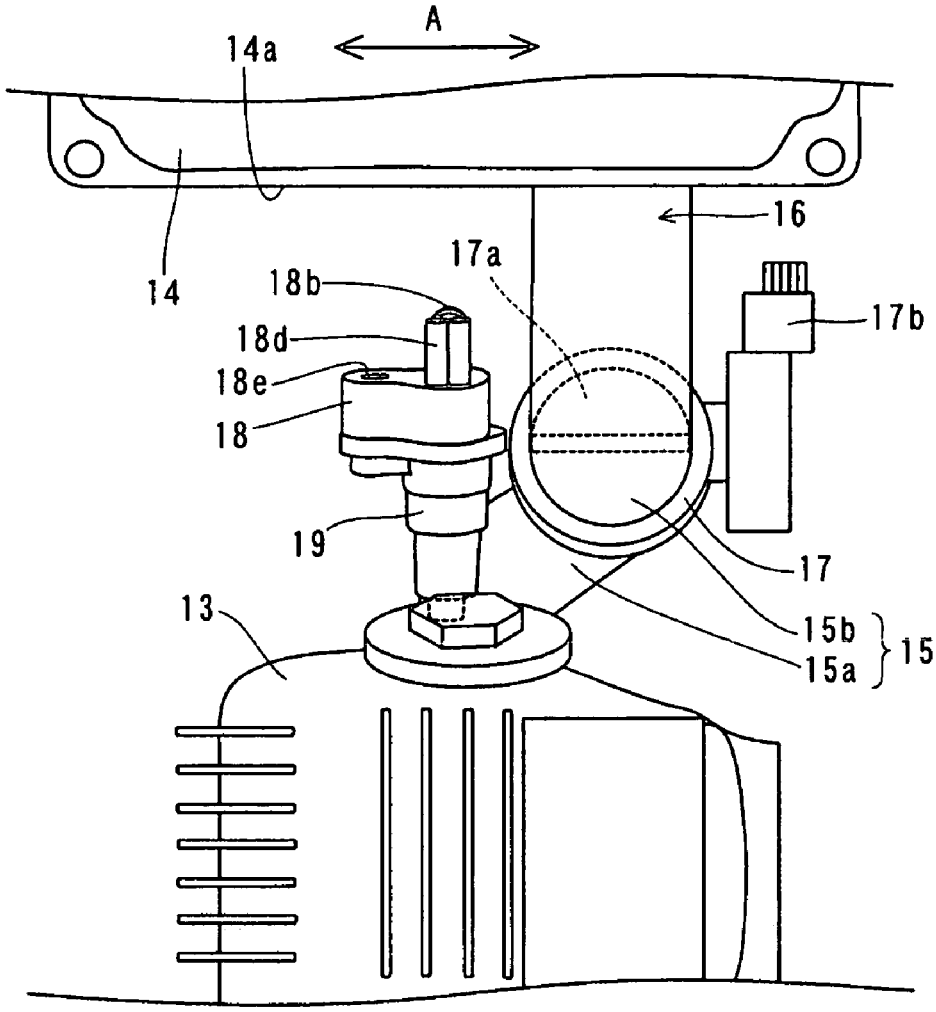
FIG. 5 is a front view of a fuel injector and its surroundings of the motorcycle according to the preferred embodiment shown in FIG. 1.
Figure 6:
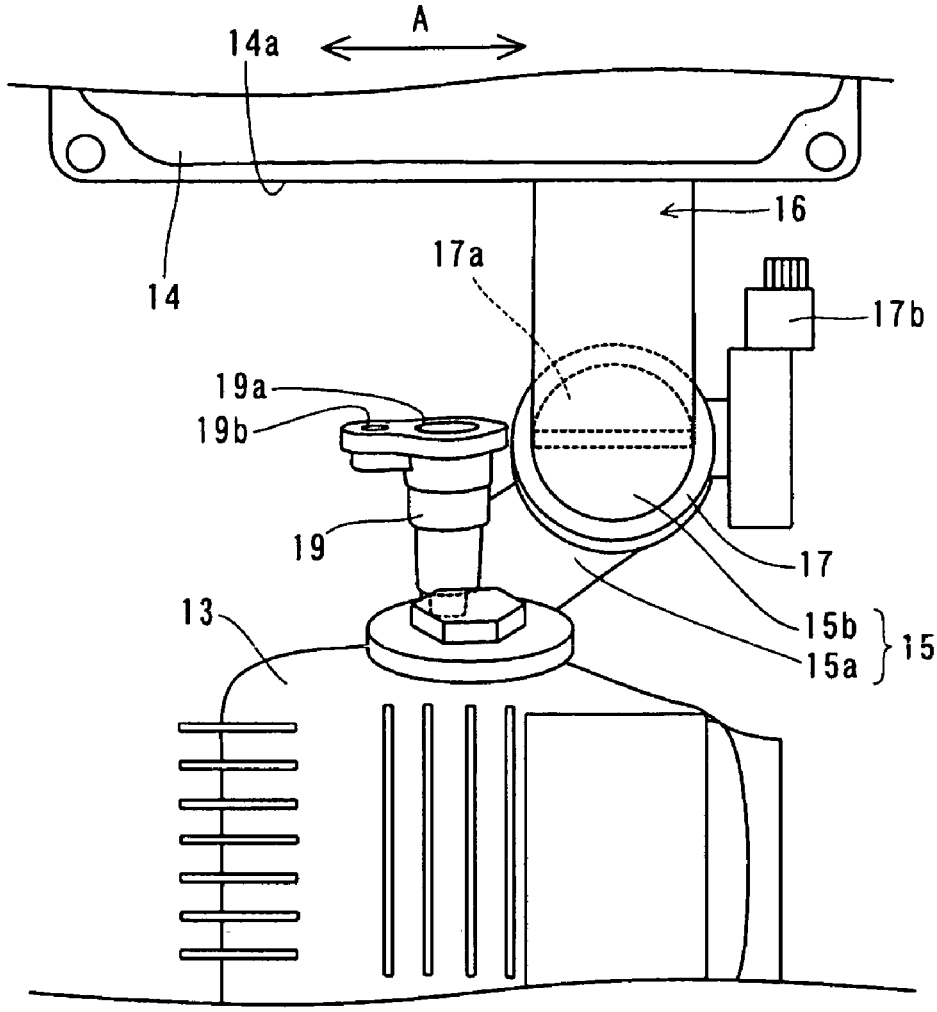
FIG. 6 is a front view, showing the fuel injector of the motorcycle according to the preferred embodiment shown in FIG. 5 removed from a mounting member.
Figure 7:
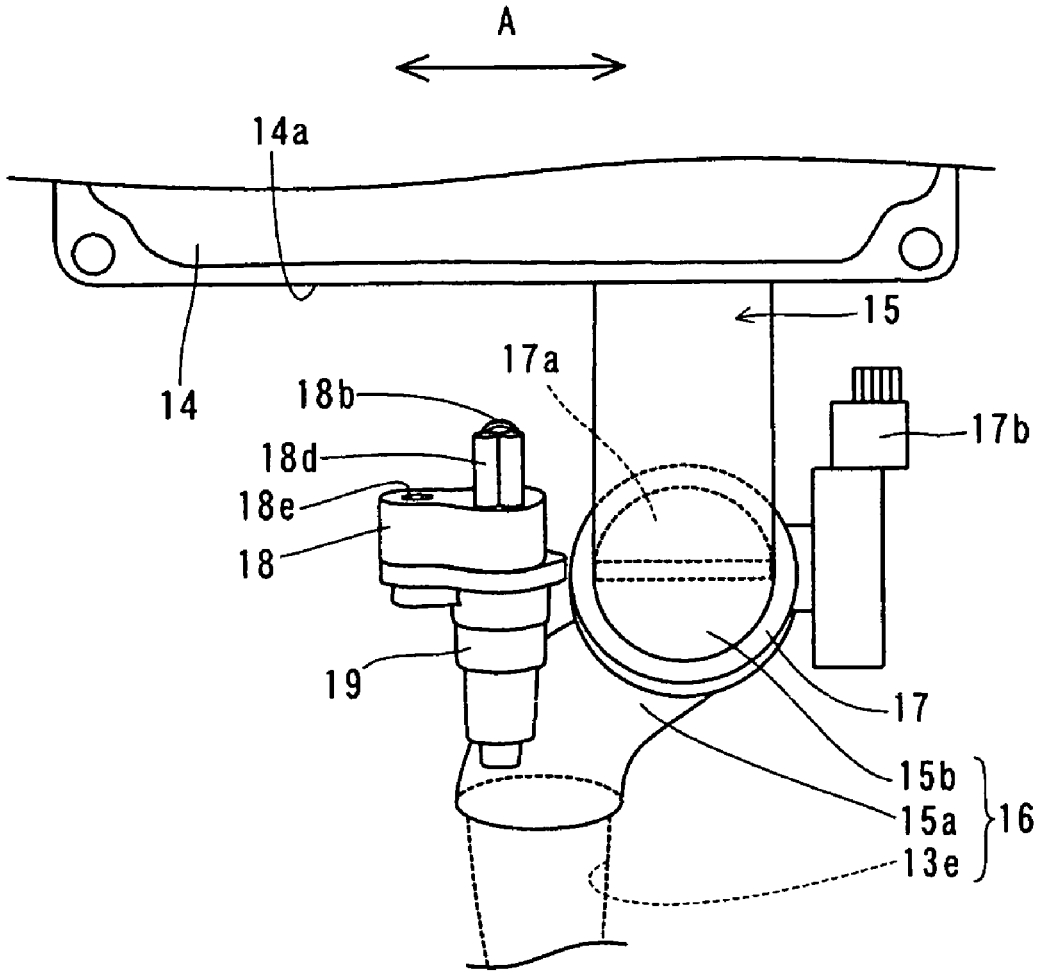
FIG. 7 is a front view of the fuel injector and its surroundings of the motorcycle according to the preferred embodiment shown in FIG. 1.

In the present preferred embodiment of the present invention, the fuel injector 18 for supplying gasoline to the engine 13 (see FIG. 5) is fixed to the intake passage portion 15*a* of the intake pipe 15 through a metal mounting member 19, as shown in FIGS. 5 and 7. The mounting member 19 has, as shown in FIG. 6, an insertion hole 19*a* through which the fuel injector 18 is inserted and a screw hole 19*b* through which the fuel injector 18 is screwed to the mounting member 19. As shown in FIG. 7, the mounting member 19 is attached to the intake passage portion 15*a* of the intake passage 16 or a portion bent in the lateral direction of the vehicle body ("A" direction). In addition, the mounting member 19, which is attached to the intake passage portion 15*a* or the portion bent in the lateral direction of the vehicle body ("A" direction in FIG. 7), extends substantially upward in the vertical direction, as shown in FIGS. 5 and 7. As shown in FIG. 3, the mounting member 19 attached to the intake passage portion 15*a* of the intake passage 16 is angled forward.

Figure 9:
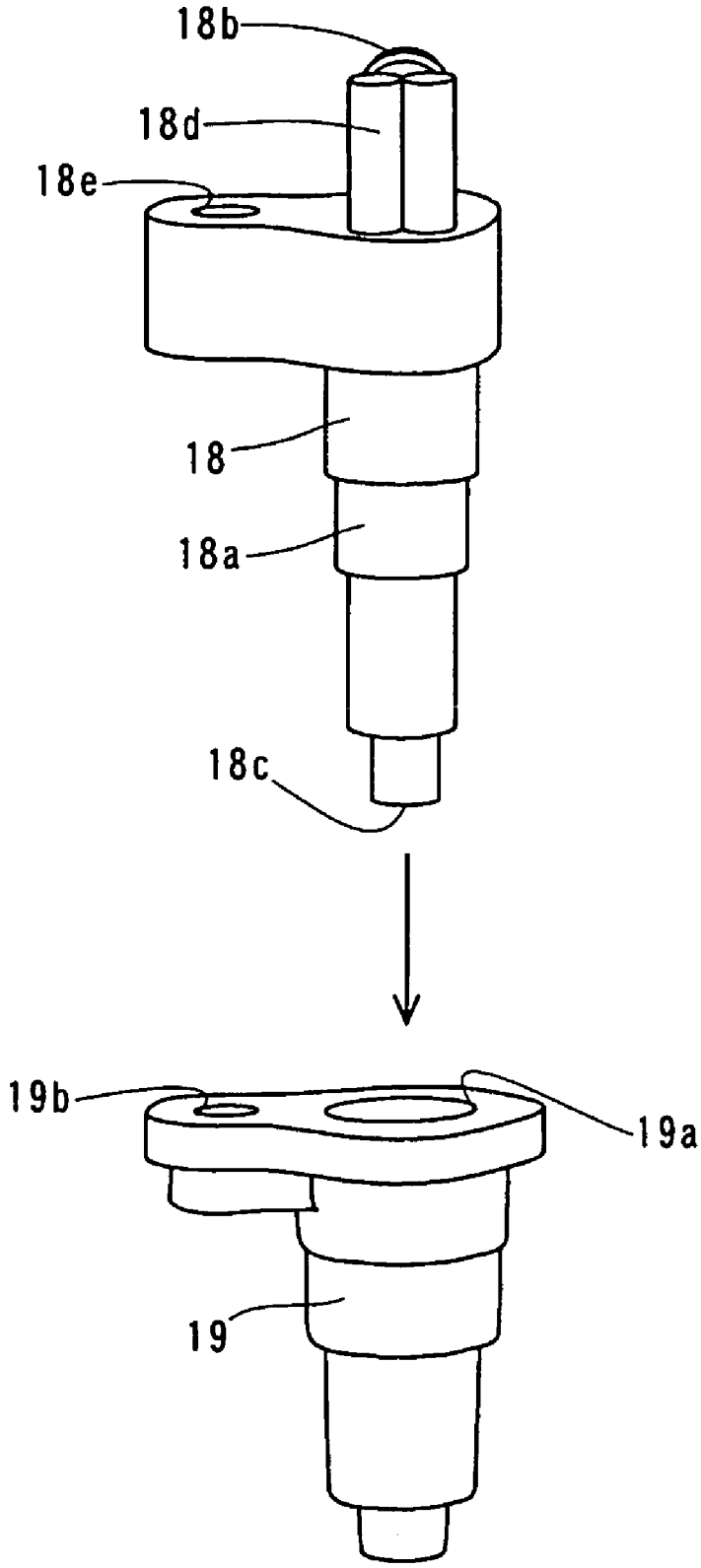
FIG. 9 is a front view of the fuel injector of the motorcycle according to the preferred embodiment shown in FIG. 1 to be mounted to the mounting member.

In the present preferred embodiment of the present invention, the fuel injector 18 mounted to the mounting member 19 is located above the engine 13 and below the main frame 3, as shown in FIGS. 2 and 4. The fuel injector 18 is located between the engine 13 and the air cleaner 14, when viewed from the front. As shown in FIG. 9, the fuel injector 18 includes an insertion portion 18*a* to be inserted into the insertion hole 19*a* of the mounting member 19, a hose mounting portion 18*b* for mounting a supply hose 27 (see FIG. 1) designed to supply gasoline, an injection portion 18*c* having plural injection holes (not shown) for injecting gasoline, a wire portion 18*d* for transmitting an electrical signal to control opening/closing of the injection holes of the injection portion 18*c*, and a screw hole 18*e* to be fastened to the mounting member 19. The insertion portion 18*a* of the fuel injector 18 is inserted through the insertion hole 19*a* of the mounting member 19. A screw (not shown) is engaged with the screw hole 18*e* of the fuel injector 18 as well as the screw hole 19*b* of the mounting member 19. As shown in FIG. 3, the injection portion 18*c* is located so as to inject gasoline toward the inlet port 13*a* of the combustion chamber 13*c*.

Figure 8:
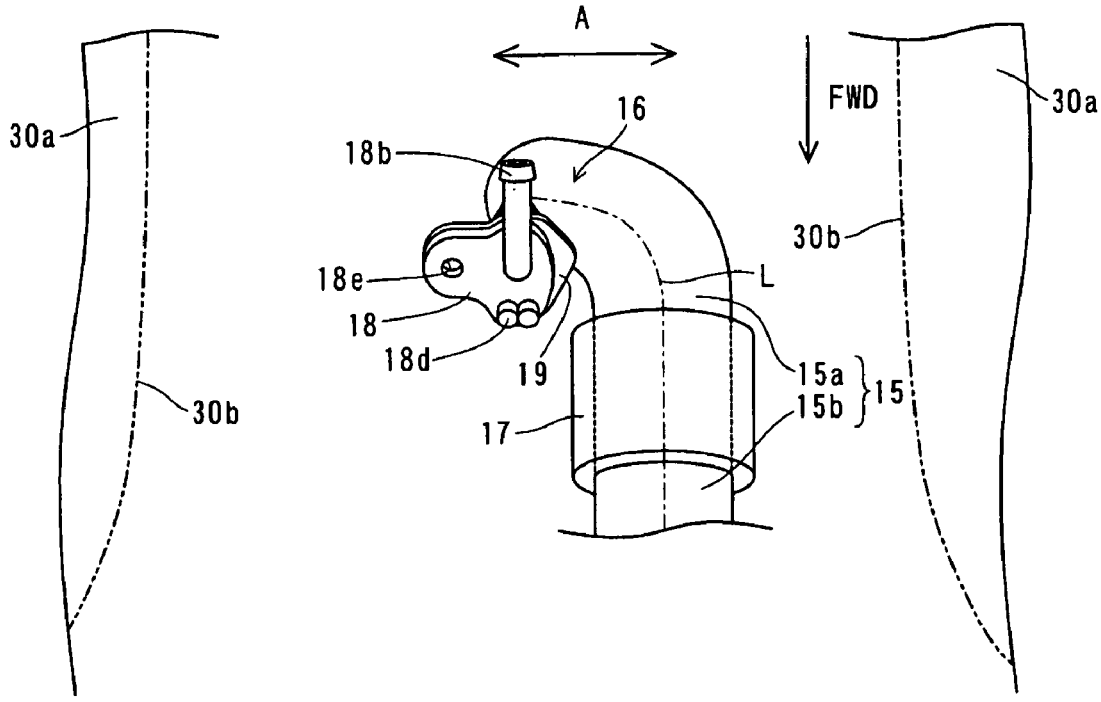
FIG. 8 is a top plan view of the fuel injector and its surroundings of the motorcycle according to the preferred embodiment shown in FIG. 1.
Figure 10:
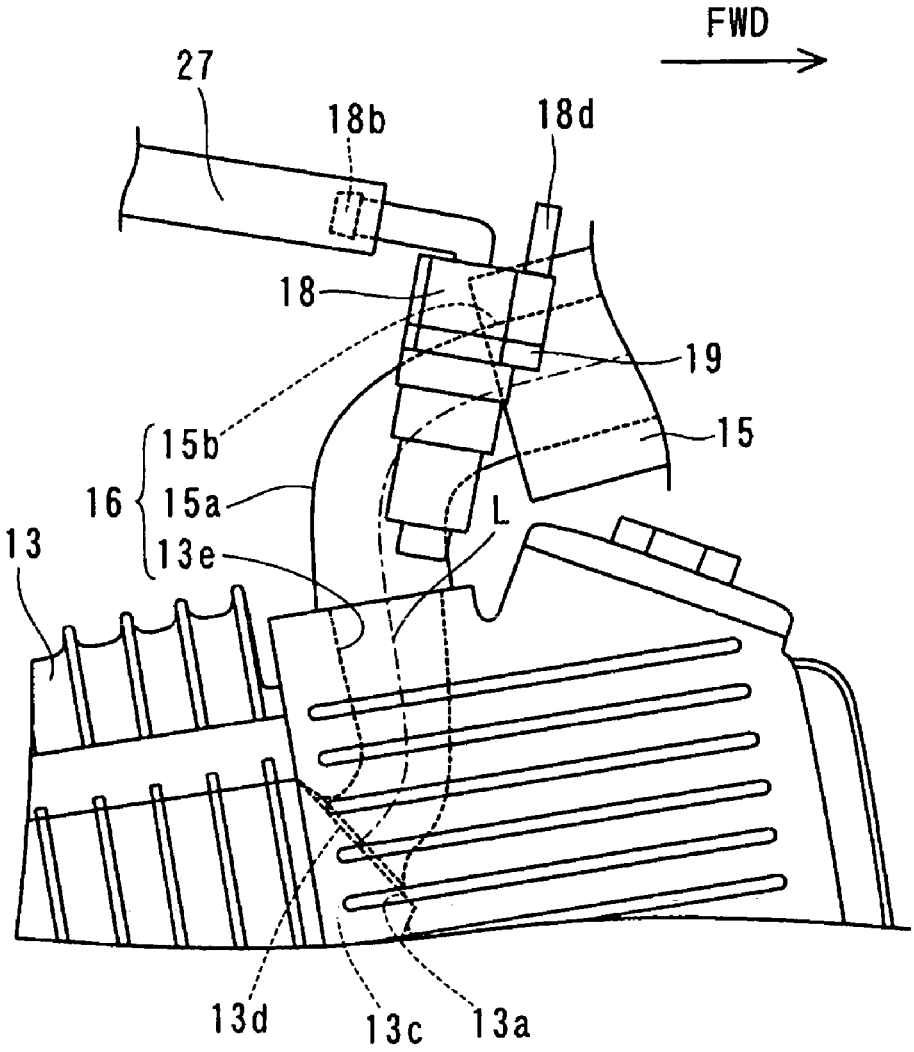
FIG. 10 is a side view of the engine and its surroundings of the motorcycle according to the preferred embodiment shown in FIG. 1, when viewed from the right side in the direction of the motorcycle motion.

In the present preferred embodiment of the present invention, as shown in FIGS. 3 and 10, the position where the fuel injector 18 is attached to the intake passage 16 is located forward relative to a centerline L of the intake passage portion 13*e* of the intake passage 16, when viewed from the side of the vehicle body. As shown in FIG. 3, the fuel injector 18 and the mounting member 19 are arranged substantially forward relative to the centerline L of the intake passage portion 13*e* of the engine 13, when viewed from the side of the vehicle body. The injection portion 18*c* of the fuel injector 18 is also arranged forward relative to the centerline L of the intake passage portion 15*a* and the intake passage portion 13*e*. The fuel injector 18 and the mounting member 19 are arranged rearward relative to a portion of the intake passage portion 15*b*, which is closer to the air cleaner 14, as shown in FIGS. 2 and 8. As shown in FIGS. 5 and 7, the fuel injector 18 and the mounting member 19 are positioned such that their front sides are not covered with the intake passage 16 (intake passage portion 15*b*). A space is provided at the rear of the fuel injector 18 attached to the intake passage portion 15*a*bent in the lateral direction of the vehicle body ("A" direction in FIG. 4).

An exhaust pipe 20 is attached to the exhaust passage portion 13*g* of the engine 13 as shown in FIG. 1. As shown in FIGS. 1 and 4, the exhaust pipe 20 curves toward the right in the direction of the vehicle motion (direction indicated by the arrow FWD), then extends rearward, and then connects to a muffler 21.

The rear arm bracket 4 connecting to the main frame 3 is provided with a pivot shaft 22. The pivot shaft 22 supports the rear arm 23, allowing its rear end to swing up/down. A rear wheel 24 is rotatably attached to the rear end of the rear arm 23. The seat rail 5 supports the rear arm 23 through a rear shock absorber 25. A metal fuel tank 26 is installed above the seat rail 5. One end of the rubber supply hose 27 is attached to the outside bottom of the fuel tank 26. The other end of the supply hose 27 is attached to a hose mounting portion 18*b* of the fuel injector 18, as shown in FIG. 2. A fuel pump 28 is fixed to the supply hose 27 and is designed to supply gasoline from the fuel tank 26 to the fuel injector 18, as shown in FIG. 1. A seat 29 is disposed above the fuel tank 26. A body cover 30 is mounted to extend from the front to the rear of the vehicle body so that it can cover the head pipe 2 and the seat rail 5.

In the present preferred embodiment of the present invention, as shown in FIGS. 1 and 4, a pair of leg shields 30*a* is provided forward of the body cover 30 with a given distance therebetween in the lateral direction of the vehicle body ("A" direction in FIG. 4) relative to the direction of the vehicle motion (indicated by the arrow FWD in FIG. 1). The leg shields 30*a* are disposed so as to sandwich the fuel injector 18 from both sides as shown in FIGS. 4 and 8. The leg shields 30*a* respectively have an inner side surface 30b extending in the direction of the vehicle body height and longitudinal length. The inner side surfaces 30*b* of the pair of leg shields 30*a* are arranged such that a distance between them becomes greater toward the front. The body cover 30 has a rear fender 31 attached to its rear end as shown in FIG. 1. The rear fender 31 is designed to cover the rear wheel 24 from above.

In the present preferred embodiment of the present invention, as described above, the position where the fuel injector 18 is attached to the intake passage 16 (intake passage portion 15*a*) is located forward relative to the centerline L of the intake passage 16 (intake passage portion 13*e*), when viewed from the side of the vehicle body. This allows a position where the fuel injector 18 is attached to the intake passage 16 (intake passage portion 15*a*) to be located forward of the intake passage 16, which helps head wind directly hit the fuel injector 18 and the mounting member 19. Thus, a sufficient amount of head wind can be ensured to cool the fuel injector 18 and the mounting member 19. Cooling the mounting member 19 results in indirect cooling of the insertion portion 18*a* of the fuel injector 18, which is inserted through the insertion hole 19*a* of the mounting member 19. This can prevent the temperature of the fuel injector 18 from becoming high. A position where the fuel injector 18 is attached to the intake passage 16 (intake passage portion 15*a*) is located forward relative to the centerline L of the intake passage 16, when viewed from the side of the vehicle body. This allows installation and maintenance of the fuel injector 18 to be done from the front of the vehicle body. Unlike the installation and maintenance of the fuel injector 18 to be done from the back of the intake passage 16, the body cover 30 and the engine 13 need not be removed. This can facilitate installation and maintenance of the fuel injector 18.

In the present preferred embodiment of the present invention, the fuel injector 18 is positioned such that its front side is not covered with the intake passage 16 (intake passage portion 15*b*). This can prevent the intake passage 16 (intake passage portion 15*b*) from blocking the head wind directed to the front side of the fuel injector 18, thus increasing an amount of head wind that directly hits the fuel injector 18. Thus, a sufficient amount of head wind can be ensured to cool the fuel injector 18 which prevents the temperature of the fuel injector 18 from becoming high. Since the fuel injector 18 is positioned such that its front side is not covered with the intake passage 16 (intake passage portion 15*b*), installation and maintenance of the fuel injector 18 can be done more easily from the front of the vehicle body facilitating the installation and maintenance of the fuel injector 18.

In the present preferred embodiment of the present invention, the fuel injector 18 and the mounting member 19 are positioned such that their front sides are not covered with the intake passage 16. This helps head wind directly hit the fuel injector 18 as well as the mounting member 19. Thus, a sufficient amount of head wind can be ensured to cool not only the fuel injector 18 but also the mounting member 19. Cooling the mounting member 19 results in indirect cooling of part of the fuel injector 18, which is arranged inside the mounting member 19. In the case that the mounting member 19 is additionally provided for mounting the fuel injector 18 to the intake passage 16, the temperature of the fuel injector 18 can also be prevented from becoming high.

In the present preferred embodiment of the present invention, the intake passage 16 is provided with the intake passage portion 15*a* having a section bent in the lateral direction of the vehicle body ("A" direction in FIG. 4), to which the fuel injector 18 is fixed. Thus, the intake passage 16 is arranged rearward of an area where the intake passage portion 15*a*, having the section bent in the lateral direction of the vehicle body ("A" direction in FIG. 4), is positioned. This can provide a space rearward of the fuel injector 18 fixed to the intake passage portion 15*a* having the section bent in the lateral direction of the vehicle body ("A" direction in FIG. 4). Thus, head wind hitting the fuel injector 18 can be easily led to the space provided rearward of the fuel injector 18, which can increase an amount of head wind directed to the fuel injector 18. As a result, the temperature of the fuel injector 18 can be more effectively prevented from becoming high.

In the present preferred embodiment of the present invention, the fuel injector 18 is disposed below the main frame 3 of the body frame, so that the fuel injector 18 can be accommodated in the space between the main frame 3 of the body frame and the engine 13.

In this preferred embodiment, the fuel injector 18 is disposed above the engine 13, which can protect the fuel injector 18 from stones, debris, etc.

Also, in this preferred embodiment, the fuel injector 18 is disposed rearward of the front fender 9, which can protect the wire portion 18d of the fuel injector 18 from mud or water splashing from the front wheel 8 while the motorcycle is running. This can reduce the chance of failure of the fuel injector 18.

Further in this preferred embodiment, the bottom surface 14*a* of the air cleaner 14 and the inner surfaces 30*b* of the pair of leg shields 30*a* form a wind introduction passage so as to enclose an area above the fuel injector 18 and the sides thereof. Thus, the fuel injector 18 can be more directly exposed to head wind. Thus, a sufficient amount of head wind can be ensured to cool the fuel injector 18, which prevents the temperature of the fuel injector 18 from becoming high.

Further in this preferred embodiment, the inner side surfaces 30*b* of the pair of leg shields 30*a* are arranged such that a distance between the inner side surfaces 30*b* becomes greater toward the front. This can easily lead a greater amount of head wind to the wind introduction passage made up of the bottom surface 14*a* of the air cleaner 14 and the inner surfaces 30*b* of the leg shields 30*a* so as to enclose the area above the fuel injector 18 and the sides thereof. Thus, a greater amount of head wind can be directed to the fuel injector 18. Therefore, the temperature of the fuel injector 18 can be more effectively prevented from becoming high.

Additionally in this preferred embodiment, the fuel injector 18 is located between the engine 13 and the air cleaner 14, when viewed from the front of the vehicle body. This results in the fuel injector being arranged in the wind introduction passage between the engine 13 and the air cleaner 14. This allows head wind to more directly hit the fuel injector 18, which ensures a sufficient amount of head wind to be used for cooling the fuel injector 18. As a result, the temperature of the fuel injector 18 can be more prevented from becoming high.

It should be obvious that the present preferred embodiment is disclosed herein simply for the purpose of showing an example in all respects, rather than the limitations. The scope of the present invention is not defined by the description of the present preferred embodiment, but defined by the scope of the claims, and includes the meanings equivalent to those of the scope of the claims as well as any modifications to be fallen within the scope of the claims.

For example, the above-described preferred embodiment shows the underbone type of motorcycle with the main frame positioned lower. However, the present invention is not limited to that. Other vehicles, including different types of motorcycles from the underbone type motorcycle, such as three-wheelers and all terrain vehicles (ATV), are also applicable as long as the vehicle is provided with a fuel injector for supplying fuel to the engine.

Figure 11:
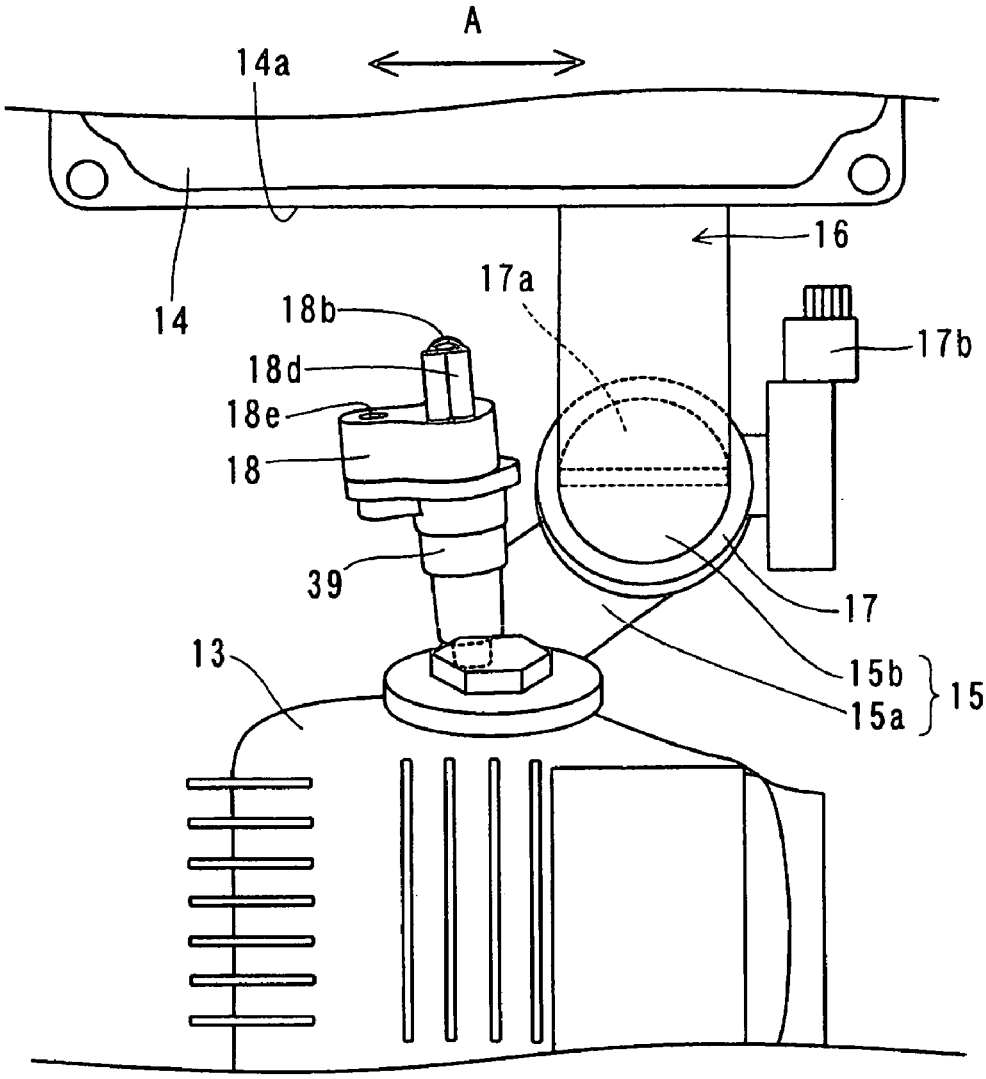
FIG. 11 is a front view of the fuel injector of the motorcycle according to a first variation of the preferred embodiment of the invention.

The above-described preferred embodiment shows the example in which the mounting member and the fuel injector are mounted in a substantially upstanding position, when viewed from the front of the vehicle body. However, the present invention is not limited to that. As shown by the first variation of the preferred embodiment of the present invention in FIG. 11, the mounting member 39 and the fuel injector 18 may be mounted in a position angled to the lateral direction of the vehicle body ("A" direction in FIG. 11), when viewed from the front of the vehicle body. In such case, because the top end of the fuel injector 18 can be positioned lower, the main frame 3 of the body frame can also be positioned lower. This allows the body cover of the main frame 3 to be positioned lower so that a rider can easily straddle the body cover when he or she gets on and off the vehicle. As a result, the rider can easily get on and off the vehicle.

Figure 12:
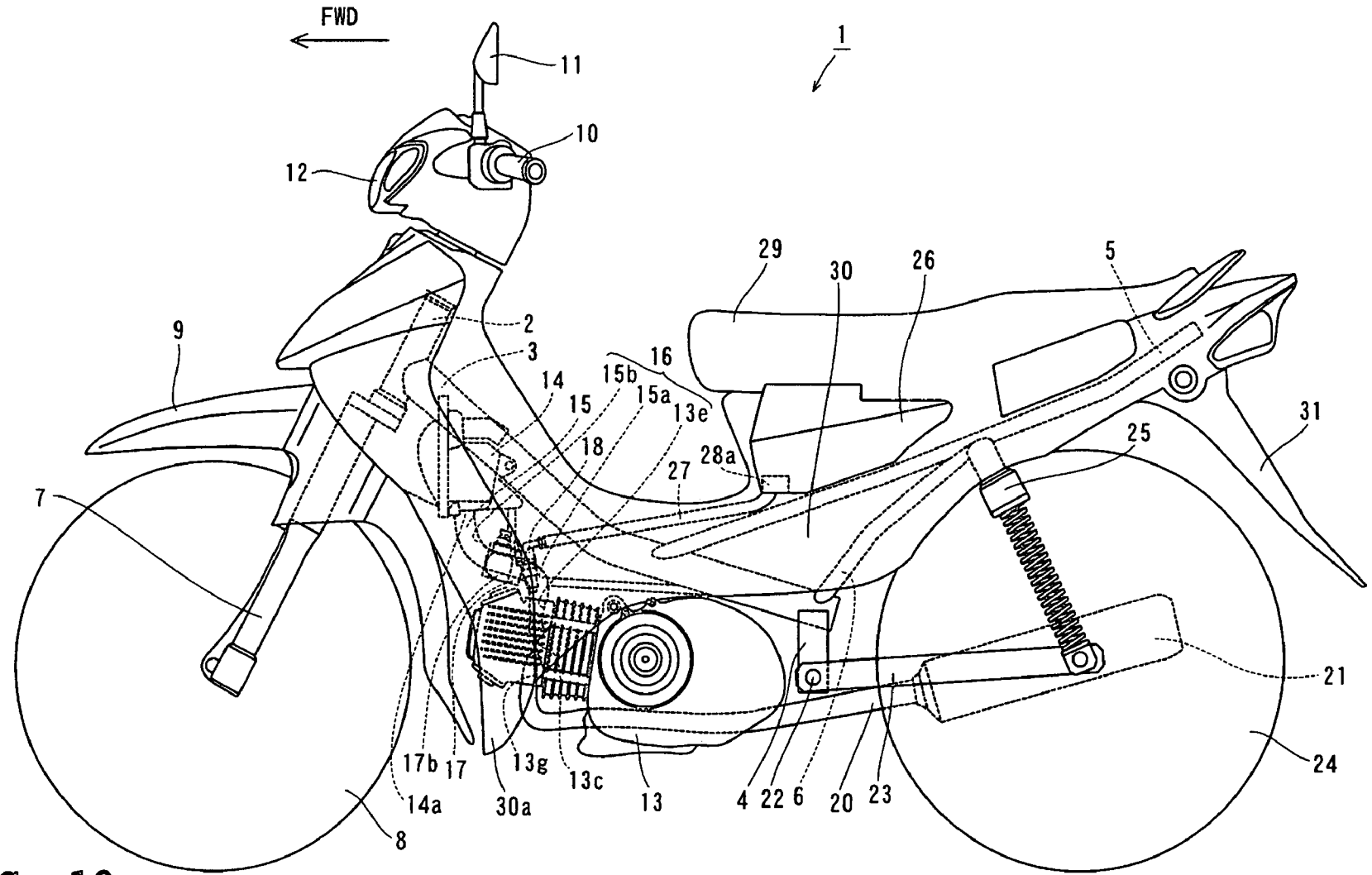
FIG. 12 is a side view of a fuel pump of the motorcycle according to a second variation of the preferred embodiment of the invention.

The above-described preferred embodiments show the example in which the fuel pump is fixed to the supply hose mounted to the outside of the fuel tank. However, the present invention is not limited to that. As shown by the second variation in FIG. 12, the fuel pump 28*a* may be disposed inside of the fuel tank 26.

The above-described preferred embodiments show the example in which the mounting member is angled forward for attachment to the intake passage. However, the present invention is not limited to that. The mounting member may not be angled in the longitudinal direction for attachment to the intake passage or it may be angled rearward for attachment to the intake passage.

The above-described preferred embodiments show the example in which the fuel injector is mounted to the intake passage through the mounting member. However, the present invention is not limited to that. The fuel injector may be mounted directly to the intake passage.

The above-described preferred embodiments show the example in which the fuel injector is disposed below the body frame. However, the present invention is not limited to that. The fuel injector may be positioned in any area except below the body frame.

What is claimed is:

1. A vehicle comprising:

a body frame extending downward and to the rear of the vehicle;

an engine arranged below the body frame, a cylinder axis of the engine being oriented substantially horizontally and extending in a forward direction of the vehicle; and an intake passage arranged to supply air to the engine; and a fuel injector mounted on a midsection of the intake passage and arranged to supply fuel to the engine; wherein at least a portion of the fuel injector is arranged forward relative to a centerline of the intake passage, when viewed from the side of the vehicle; and the intake passage includes a first intake passage portion arranged to continue from an inlet port of the engine and extend upward, a second intake passage portion arranged to continue from the first intake passage portion and have a section bent in the lateral direction of the vehicle body, the fuel injector being mounted to the second intake passage portion, and a third intake passage portion arranged to continue from the second intake passage portion and arranged forward of the fuel injector and extended upward, and wherein the third intake passage portion is disposed so as not to cover a front side of the fuel injector, when viewed from a front of the vehicle.

2. The vehicle according to claim 1, wherein the fuel injector is disposed below the body frame.

3. The vehicle according to claim 2, wherein the fuel injector is mounted in a position angled to the lateral direction of the vehicle when viewed from a front of the vehicle.

4. The vehicle according to claim 1, wherein the fuel injector is disposed above the engine.

5. The vehicle according to claim 4, further comprising a front wheel and a front fender arranged to cover the front wheel from above, wherein the fuel injector is disposed above the engine and rearward of the front fender.

6. The vehicle according to claim 1, further comprising an air cleaner arranged to purify air to be supplied to the engine and a pair of leg shields provided with a given distance therebetween in the lateral direction of the vehicle, wherein the air cleaner is disposed forward and upward of the fuel injector and has a bottom surface extending in the lateral and longitudinal direction of the vehicle body, and wherein the leg shields are arranged to cover both sides of the fuel injector and each have an inner side surface extending in the direction of the vehicle height and length.

7. The vehicle according to claim 6, wherein the inner side surfaces of the pair of leg shields are arranged such that a distance between them becomes greater toward the front of the vehicle.

8. The vehicle according to claim 6, wherein the fuel injector is located between the engine and the air cleaner.

9. The vehicle according to claim 1, further comprising a mounting member arranged to mount the fuel injector to the intake passage, and wherein the front side of the fuel injector and a front side of the mounting member, when viewed from a front of the vehicle, are not covered by the second and third portions of the intake passage extending forward and upward of the intake passage.

10. The vehicle according to claim 1, wherein a position where the fuel injector is mounted to the intake passage is located forward relative to a centerline of the intake passage, when viewed from the side of the vehicle.

11. The vehicle according to claim 1, wherein the second intake passage portion having a section bent in the lateral direction of the vehicle creates an empty space rearward of where the fuel injector is mounted to the intake passage.

12. The vehicle according to claim 1, further comprising a supply hose connected to the fuel injector and a fuel pump fixed to the supply hose.

13. The vehicle according to claim 1, further comprising a fuel tank and a fuel pump, wherein the fuel pump is disposed inside the fuel tank.

* * * * *